US010065239B2

(12) United States Patent
Marcin, Jr. et al.

(10) Patent No.: US 10,065,239 B2
(45) Date of Patent: Sep. 4, 2018

(54) CASTING MOLDS, MANUFACTURE AND USE METHODS

(71) Applicant: United Technologies Corporation, Hartford, CT (US)

(72) Inventors: John J. Marcin, Jr., Marlborough, CT (US); Steven J. Bullied, Pomfret Center, CT (US); Dilip M. Shah, Glastonbury, CT (US); Alan D. Cetel, West Hartford, CT (US); Emily K. Kreek, Charlotte, NC (US)

(73) Assignee: United Technologies Corporation, Farmington, CT (US)

( * ) Notice: Subject to any disclaimer, the term of this patent is extended or adjusted under 35 U.S.C. 154(b) by 276 days.

(21) Appl. No.: 14/488,169

(22) Filed: Sep. 16, 2014

(65) Prior Publication Data

US 2015/0075745 A1 Mar. 19, 2015

Related U.S. Application Data

(60) Provisional application No. 61/878,911, filed on Sep. 17, 2013.

(51) Int. Cl.

| | |
|---|---|
| ***B22D 46/00*** | (2006.01) |
| ***B22D 2/00*** | (2006.01) |
| ***B22D 27/04*** | (2006.01) |
| ***B22D 30/00*** | (2006.01) |
| ***B22C 9/04*** | (2006.01) |

(52) U.S. Cl.
CPC ..... *B22D 46/00* (2013.01); *B22C 9/04* (2013.01); *B22D 2/006* (2013.01); *B22D 27/045* (2013.01); *B22D 30/00* (2013.01)

(58) Field of Classification Search
CPC .. B22C 9/02; B22C 9/04; B22D 2/006; B22D 46/00; B22D 27/045; B22D 30/00
USPC ..... 164/4.1, 458, 151.4, 15, 361
See application file for complete search history.

(56) References Cited

U.S. PATENT DOCUMENTS

| | | | | |
|---|---|---|---|---|
| 3,669,179 | A | 6/1972 | Federman | |
| 3,931,847 | A | 1/1976 | Terkelsen | |
| 4,210,193 | A | 7/1980 | Rühle | |
| 4,493,362 | A * | 1/1985 | Moore et al. | B22D 17/32 164/113 |
| 4,536,455 | A | 8/1985 | Maeda et al. | |
| 4,570,230 | A * | 2/1986 | Wilson et al. | G01F 23/22 164/450.3 |
| 7,867,334 | B2 * | 1/2011 | Sakai | C30B 11/002 117/18 |
| 8,387,678 | B1 | 3/2013 | Park et al. | |

* cited by examiner

*Primary Examiner* — Kevin P Kerns
(74) *Attorney, Agent, or Firm* — Bachman & LaPointe, P.C.

(57) ABSTRACT

A casting mold (260) comprises a shell (262) extending from a lower end (264) to an upper end (266) and having: an interior space (280) for casting metal; and an opening (268) for receiving metal to be cast. A plurality of thermocouples (900) are vertically-spaced from each other on the shell.

7 Claims, 19 Drawing Sheets

CASTING MOLDS, MANUFACTURE AND USE METHODS

CROSS-REFERENCE TO RELATED APPLICATION

Benefit is claimed of U.S. Patent Application Ser. No. 61/878,911, filed Sep. 17, 2013, and entitled "Casting Molds, Manufacture and Use Methods", the disclosure of which is incorporated by reference herein in its entirety as if set forth at length.

BACKGROUND

The disclosure relates to casting. More particularly, the disclosure relates to multi-shot/pour casting.

FIG. 1 schematically illustrates a gas turbine engine 20. The exemplary gas turbine engine 20 is a two-spool turbofan having a centerline (central longitudinal axis) 500, a fan section 22, a compressor section 24, a combustor section 26 and a turbine section 28. Alternative engines might include an augmentor section (not shown) among other systems or features. The fan section 22 drives air along a bypass flowpath 502 while the compressor section 24 drives air along a core flowpath 504 for compression and communication into the combustor section 26 then expansion through the turbine section 28. Although depicted as a turbofan gas turbine engine in the disclosed non-limiting embodiment, it is to be understood that the concepts described herein are not limited to use with turbofan engines and the teachings can be applied to non-engine components or other types of turbomachines, including three-spool architectures and turbines that do not have a fan section.

The engine 20 includes a first spool 30 and a second spool 32 mounted for rotation about the centerline 500 relative to an engine static structure 36 via several bearing systems 38. It should be understood that various bearing systems 38 at various locations may alternatively or additionally be provided.

The first spool 30 includes a first shaft 40 that interconnects a fan 42, a first compressor 44 and a first turbine 46. The first shaft 40 is connected to the fan 42 through a gear assembly of a fan drive gear system (transmission) 48 to drive the fan 42 at a lower speed than the first spool 30. The second spool 32 includes a second shaft 50 that interconnects a second compressor 52 and second turbine 54. The first spool 30 runs at a relatively lower pressure than the second spool 32. It is to be understood that "low pressure" and "high pressure" or variations thereof as used herein are relative terms indicating that the high pressure is greater than the low pressure. A combustor 56 (e.g., an annular combustor) is between the second compressor 52 and the second turbine 54 along the core flowpath. The first shaft 40 and the second shaft 50 are concentric and rotate via bearing systems 38 about the centerline 500.

The core airflow is compressed by the first compressor 44 then the second compressor 52, mixed and burned with fuel in the combustor 56, then expanded over the second turbine 54 and first turbine 46. The first turbine 46 and the second turbine 54 rotationally drive, respectively, the first spool 30 and the second spool 32 in response to the expansion.

SUMMARY

One aspect of the disclosure involves a casting mold comprising a shell extending from a lower end to an upper end. The shell has an interior space for casting metal and an opening for receiving metal to be cast. A plurality of thermocouples are vertically-spaced from each other on the shell.

A further embodiment may additionally and/or alternatively include at least five said thermocouples at five different vertical positions.

A further embodiment may additionally and/or alternatively include at least five of the thermocouples being evenly vertically spaced from each other.

A further embodiment may additionally and/or alternatively include at least two sets of the thermocouples, each set having a thermocouple at the same height as a corresponding thermocouple of the other set.

A further embodiment may additionally and/or alternatively include the space comprising a plurality of part-forming compartments, each containing a casting core.

A further embodiment may additionally and/or alternatively include the thermocouples being along a single one of the part-forming compartments.

A further embodiment may additionally and/or alternatively include a method for manufacturing the mold. The method comprises shelling a pattern to form a shell and applying the thermocouples to the shell.

A further embodiment may additionally and/or alternatively include a method for using the mold. The method comprises placing the mold in a furnace, withdrawing the mold from the furnace, and during the withdrawing, receiving data from the thermocouples.

A further embodiment may additionally and/or alternatively include during the withdrawing, determining a position of the mold.

A further embodiment may additionally and/or alternatively include calculating a cooling rate at each thermocouple.

A further embodiment may additionally and/or alternatively include determining when a solidus front and a liquidus front pass each thermocouple.

A further embodiment may additionally and/or alternatively include determining a proxy vertical span of a mushy zone as a distance the mold has traveled between when said solidus front and said liquidus front pass an associated said thermocouple.

Another aspect of the disclosure involves a casting process comprising heating a casting mold in a furnace. The mold comprises a shell extending from a lower end to an upper end and having: an interior space for casting metal and an opening for receiving metal to be cast. The method comprises pouring said metal into the interior space, withdrawing the mold from the furnace, and during the withdrawing measuring a temperature of the mold and determining a position of the mold.

A further embodiment may additionally and/or alternatively include determining a vertical position of a mushy zone.

A further embodiment may additionally and/or alternatively include the pouring comprising a first pouring of a first alloy, and a second pouring of a second alloy. The second pouring commences when the mushy zone has reached a target level.

A further embodiment may additionally and/or alternatively include the method being performed repeatedly wherein: parameters are iterated to achieve a desired value of a proxy for a vertical span of a mushy zone.

A further embodiment may additionally and/or alternatively include the proxy being the vertical distance the mold passes from when a solidus front passes a thermocouple to when a liquidus front passes the thermocouple.

Another aspect of the disclosure involves a method for estimating parameters of a transition zone between two alloys in a casting. The method comprises: measuring a temperature of at least one location on a mold during withdrawal of the mold from a furnace; determining when a solidus reaches said location; and determining when a liquidus reaches said location.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
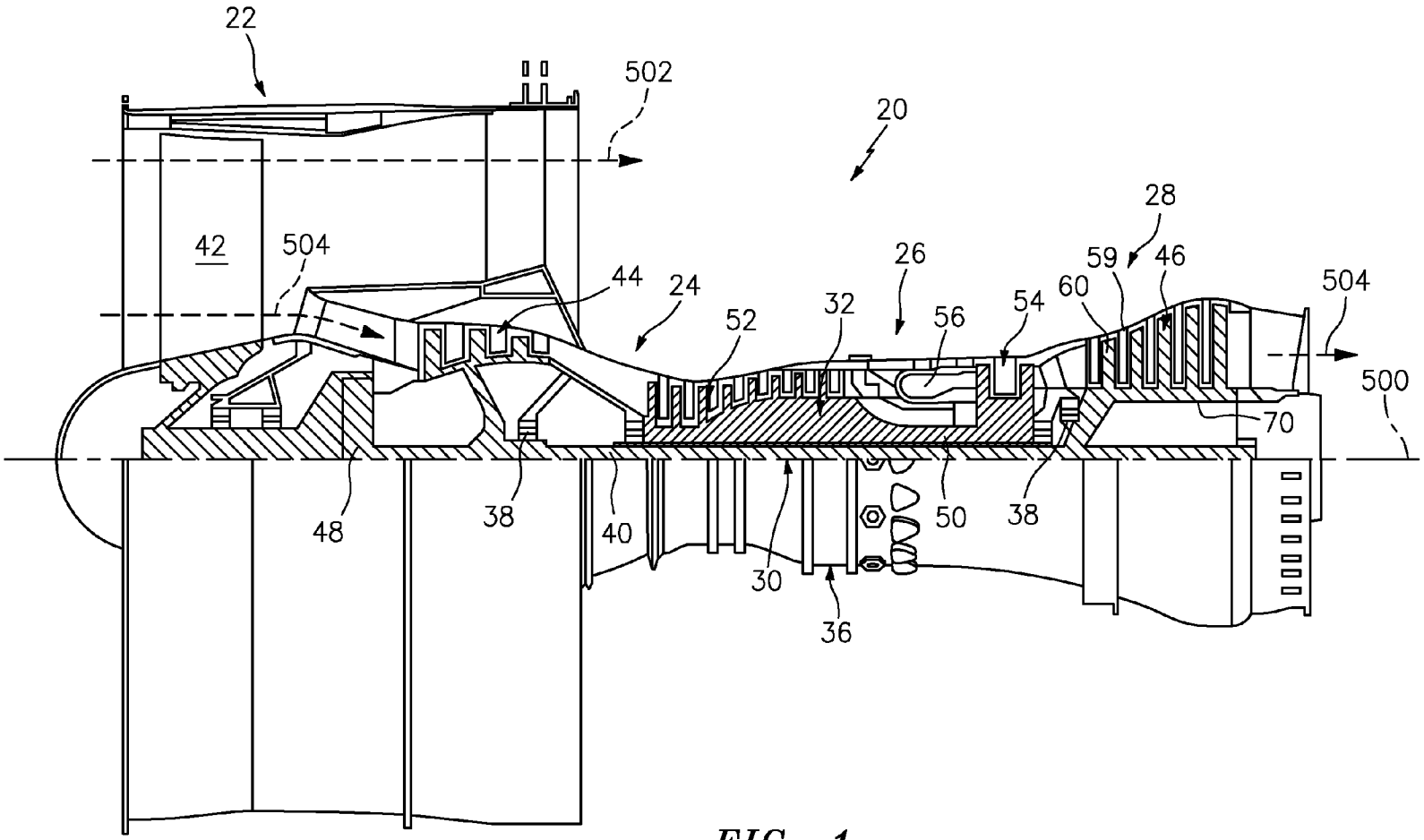
FIG. 1 is a partially schematic half-sectional view of a gas turbine engine.
Figure 2:
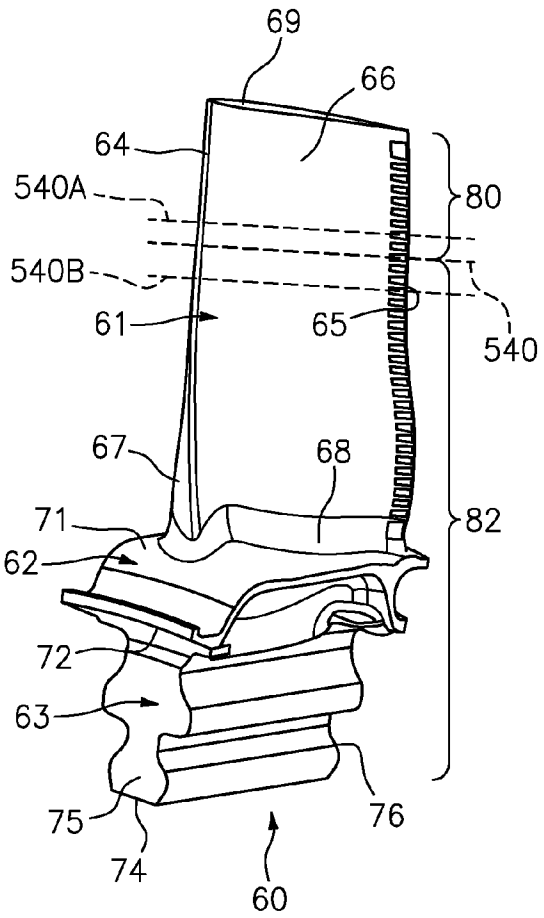
FIG. 2 is a view of a first turbine blade of the engine of FIG. 1.

The engine 20 includes many components that are or can be fabricated of metallic materials, such as aluminum alloys and superalloys. As an example, the engine 20 includes rotatable blades 60 and static vanes 59 in the turbine section 28. The blades 60 and vanes 59 can be fabricated of superalloy materials, such as cobalt- or nickel-based alloys. The blade 60 (FIG. 2) includes an airfoil 61 that projects outwardly from a platform 62. A root portion 63 (e.g., having a "fir tree" profile) extends inwardly from the platform 62 and serves as an attachment for mounting the blade in a complementary slot on a disk 70 (shown schematically in FIG. 1). The airfoil 61 extends streamwise from a leading edge 64 to a trailing edge 65 and has a pressure side 66 and a suction side 67. The airfoil extends spanwise from and inboard end 68 at the outer diameter (OD) surface 71 of the platform 62 to a distal/outboard tip 69 (shown as a free tip rather than a shrouded tip in this example).

The root 63 extends from an outboard end at an underside 72 of the platform to an inboard end 74 and has a forward face 75 and an aft face 76 which align with corresponding faces of the disk when installed.

The blade 60 has a body or substrate that has a hybrid composition and microstructure. For example, a "body" is a main or central foundational part, distinct from subordinate features, such as coatings or the like that are supported by the underlying body and depend primarily on the shape of the underlying body for their own shape. As can be appreciated however, although the examples and potential benefits may be described herein with respect to the blades 60, the examples can also be extended to the vanes 59, disk 70, other rotatable metallic components of the engine 20, non-rotatable metallic components of the engine 20, or metallic non-engine components.

The blade 60 has a tipward first section 80 fabricated of a first material and a rootward second section 82 fabricated of a second, different material. A boundary between the sections is shown as 540. For example, the first and second materials differ in at least one of composition, microstructure and mechanical properties. In a further example, the first and second materials differ in at least density. In one example, the first material (near the tip of the blade 60) has a relatively low density and the second material has a relatively higher density. The first and second materials can additionally or alternatively differ in other characteristics, such as corrosion resistance, strength, creep resistance, fatigue resistance or the like.

In this example, the sections 80/82 each include portions of the airfoil 61. Alternatively, or in addition to the sections 80/82, the blade 60 can have other sections, such as the platform 62 and the root portion 63, which may be independently fabricated of third or further materials that differ in at least one of composition, microstructure and mechanical properties from each other and, optionally, also differ from the sections 80/82 in at least one of composition, microstructure, and mechanical properties.

In this example, the airfoil 61 extends over a span from 0% span at the platform 62 to a 100% span at the tip 69. The section 82 extends from the 0% span to X % span and the section 80 extends from the X % span to the 100% span. In one example, the X % span is, or is approximately, 70% such that the section 80 extends from 70% to 100% span. In other examples, the X % can be anywhere from −20% to 99%, more particularly, −10% to 80% or −10% to 80% or 10% to 80%. In a further example, the densities of the first and second materials differ by at least 3%. In a further example, the densities differ by at least 6%, and in one example differ by 6%-10%. As is discussed further below, the X % span location and boundary 540 may represent the center of a short transition region between sections of the two pure first and second materials.

The first and second materials of the respective sections 80/82 can be selected to locally tailor the performance of the blade 60. For example, the first and second materials can be selected according to local conditions and requirements for corrosion resistance, strength, creep resistance, fatigue resistance or the like. Further, various benefits can be achieved by locally tailoring the materials. For instance, depending on a desired purpose or objective, the materials can be tailored to reduce cost, to enhance performance, to reduce weight or a combination thereof.

Figure 3:
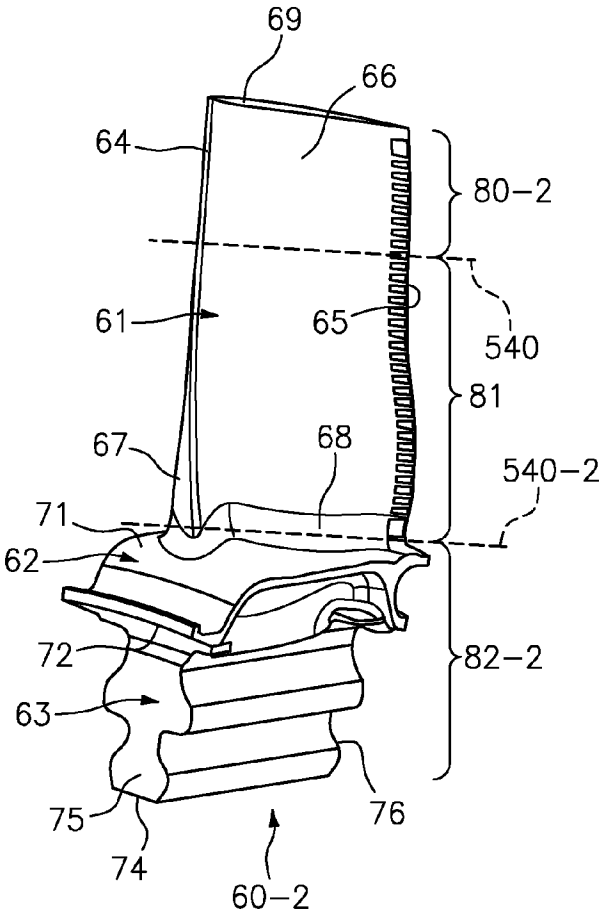
FIG. 3 is a view of an alternative turbine blade of the engine of FIG. 1.

FIG. 3 divides the blade 60-2 into three zones (a tipward Zone 1 numbered 80-2; a rootward Zone 2 numbered 82-2; and an intermediate Zone 3 numbered 81) which may be of two or three different alloys (plus transitions). Desired relative alloy properties for each zone are:

Zone 1 Airfoil Tip: low density (desirable because this zone imposes centrifugal loads on the other zones) and high oxidation resistance. This may also include a tip shroud (not shown);

Zone 2 Root & Fir Tree: high notched LCF strength, high stress corrosion cracking (SCC) resistance, low density (low density being desirable because these areas provide a large fraction of total mass);

Zone 3 Lower Airfoil: high creep strength (due to supporting centrifugal loads with a small cross-section), high oxidation resistance (due to gaspath exposure and heating), higher thermal-mechanical fatigue (TMF) capability/life.

Exemplary Zone 1/3 transition 540 is at 50-80% airfoil span, more particularly 55-75% or 60-70% (e.g., measured at the center of the airfoil section or at half chord). Exemplary Zone 2/3 transition 540-2 is at about 0% span (e.g., −5% to 5% or −10% to 10%).

Multi-shot/pour casting methods are disclosed in U.S. Patent Application Ser. No. 61/737,530, filed Dec. 17, 2012, and entitled "Hybrid Turbine Blade for Improved Engine Performance or Architecture" and U.S. Patent Application Ser. No. 61/794,519, filed Mar. 15, 2013, and entitled "Multi-Shot Casting", the disclosures of which are incorporated by reference herein in their entirety as if set forth at length.

Materials for each of the zones in the two-zone or three-zone blade may be those shown in U.S. patent applications Ser. Nos. 61/737,530, and 61/794,519 noted above.

FIGS. 4-12 show a sequence of stages in the use of a furnace 800. The exemplary furnace comprises two sources of two alloys. The respective sources are labeled 802-1 and 802-2. Each source comprises an ingot loader 804 (e.g., conventional type) having an ingot isolation valve 806 separating the ingot in a waiting position from the interior of a tilt induction melter 808. Each tilt induction melter has a ceramic crucible 810 with an interior for receiving and melting the associated ingot 811-1, 811-2. In the initial orientation, each crucible will have an open upper end and a closed lower end. The melter further comprises an induction coil 812 coupled to a power source (not shown) for melting the ingot. Each ingot may be deposited into the associated crucible 810 by opening the associated isolation valve 806 and loading the ingot (either manually or automatically) followed by closing the isolation valve. Each induction melter 808 includes an actuator (not shown) for pivoting the crucible (and coils) to pour melted material. Exemplary pivoting is about either a fixed axis 520-1, 520-2 or a moving axis.

Figure 4:
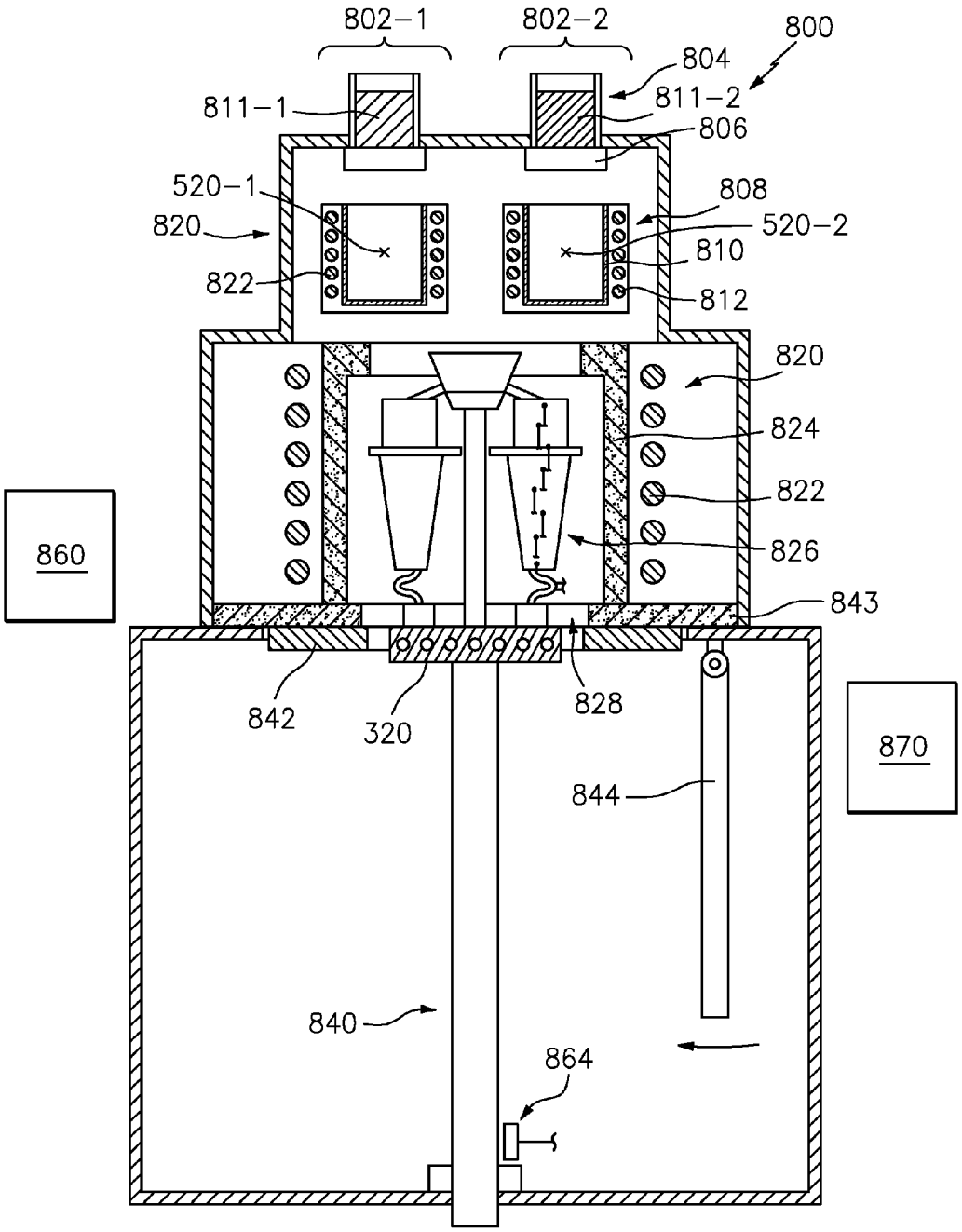
FIG. 4 is a first partially schematic view in a sequence of partially schematic views of a furnace casting the first blade.

Below the sources, the exemplary furnace includes an induction mold heater 820. The exemplary induction mold heater has an induction coil 822 surrounding a cylindrical graphite susceptor 824 which surrounds an internal cavity (mold chamber) 826 for receiving the associated mold. The mold may rest atop the aforementioned chill plate 320. The susceptor has an aperture in the top for allowing molten metals to be poured into the pour cone. The susceptor has an aperture 828 in the bottom allowing the mold to be progressively downwardly withdrawn. The withdrawal may be accomplished via an appropriate elevator system such as a water-cooled vertical ball screw system 840 supporting the chill plate. FIG. 4 further shows a fixed water-cooled chill ring 842 supporting the susceptor via an annular graphite baffle plate 843 and a mold chamber vacuum isolation valve 844. The valve 844 allows closing of the mold chamber when the chill plate and mold are fully retracted out of the mold chamber 826. This may allow heating of the chamber with the valve closed and may allow maintenance of the chamber temperature while a retracted mold is removed and replaced with a fresh mold (e.g., the valve thereafter being opened and the elevator used to raise the new mold). The exemplary valve 844 comprises a hinged valve element (door) hinged about an upper horizontal axis with an open position shown and a closed position rotated 90° clockwise about the axis as viewed. FIG. 4 shows the fresh mold raised up into the mold chamber with ingots in the loaders and empty induction melters.

Figure 5:
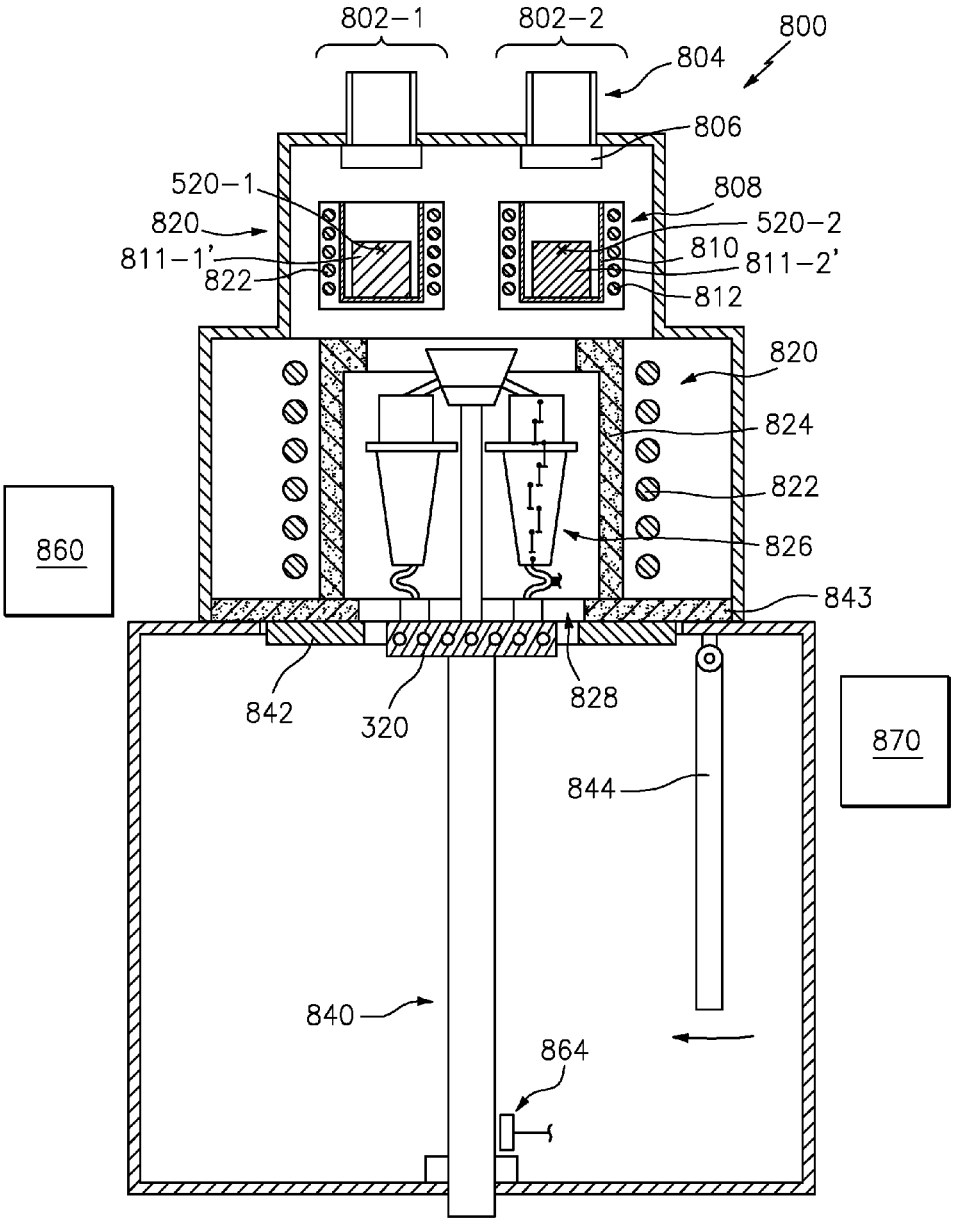
FIG. 5 is a second partially schematic view in the sequence of partially schematic views of the furnace casting the first blade.

FIG. 5 shows the ingots that have been dropped into the induction melters through the isolation valves and melted to form charges 811-1' and 811-2'.

Figure 6:
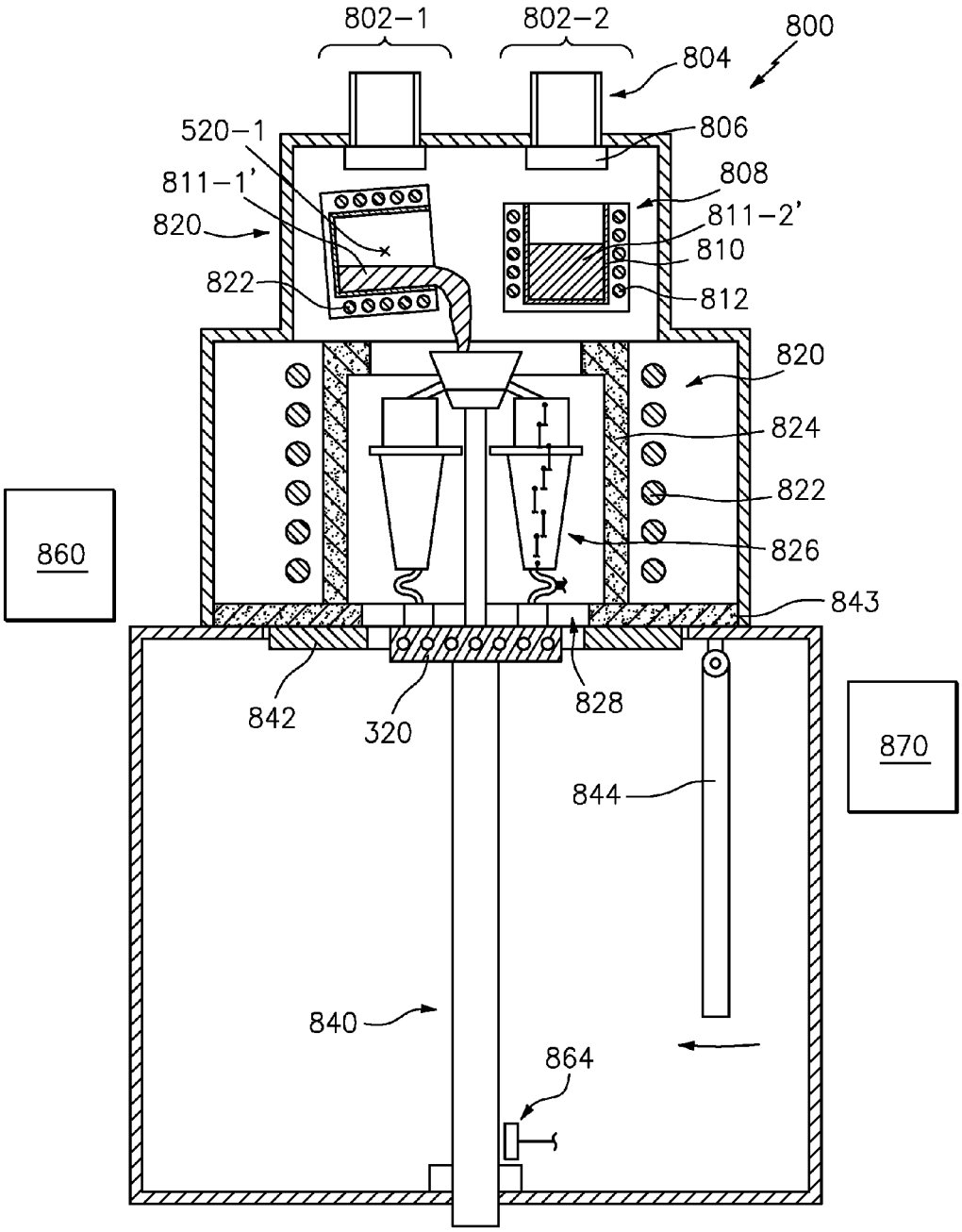
FIG. 6 is a third partially schematic view in the sequence of partially schematic views of the furnace casting the first blade.

FIG. 6 shows a pouring stage from the first melter.

Figure 7:
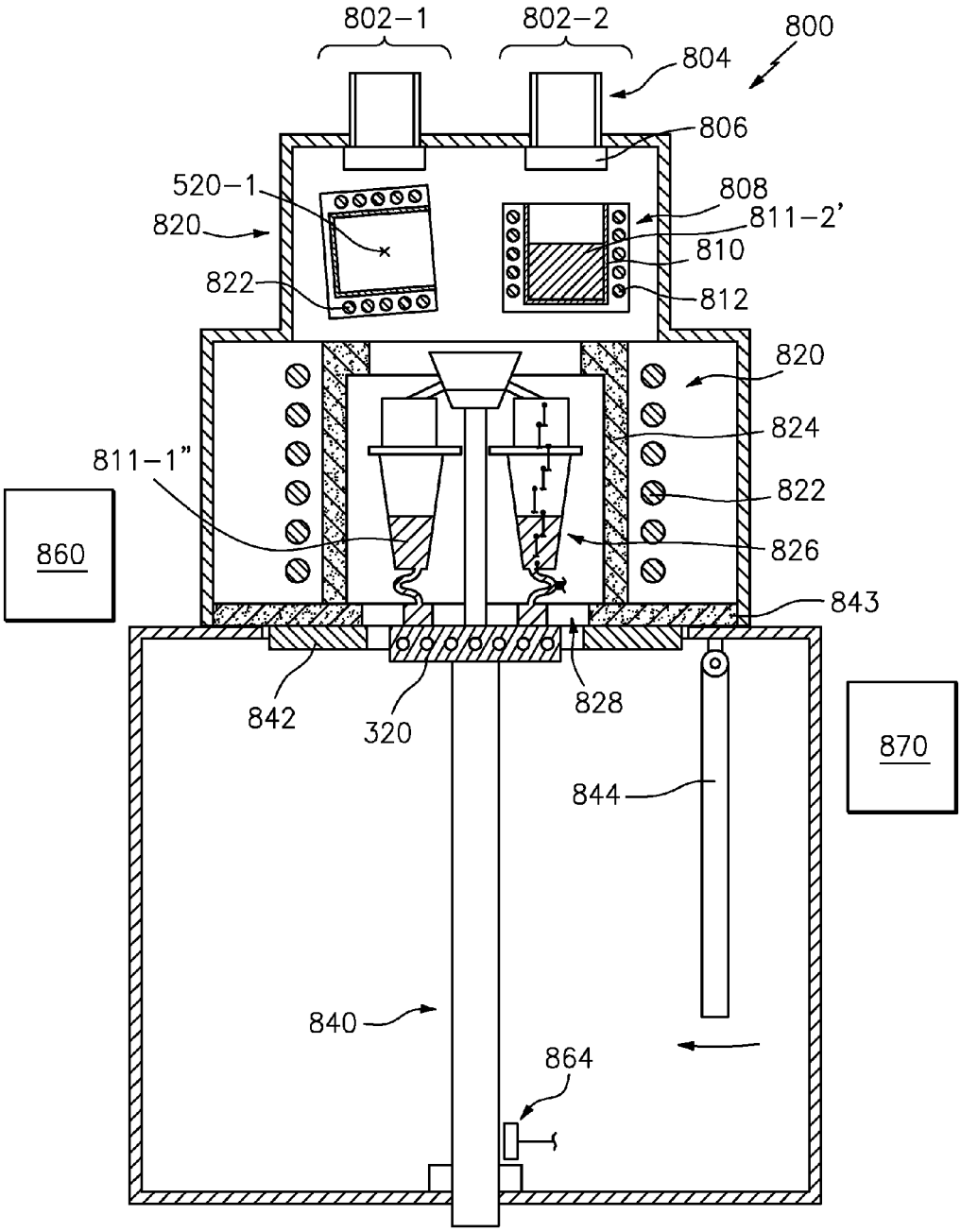
FIG. 7 is a fourth partially schematic view in the sequence of partially schematic views of the furnace casting the first blade.
Figure 8:
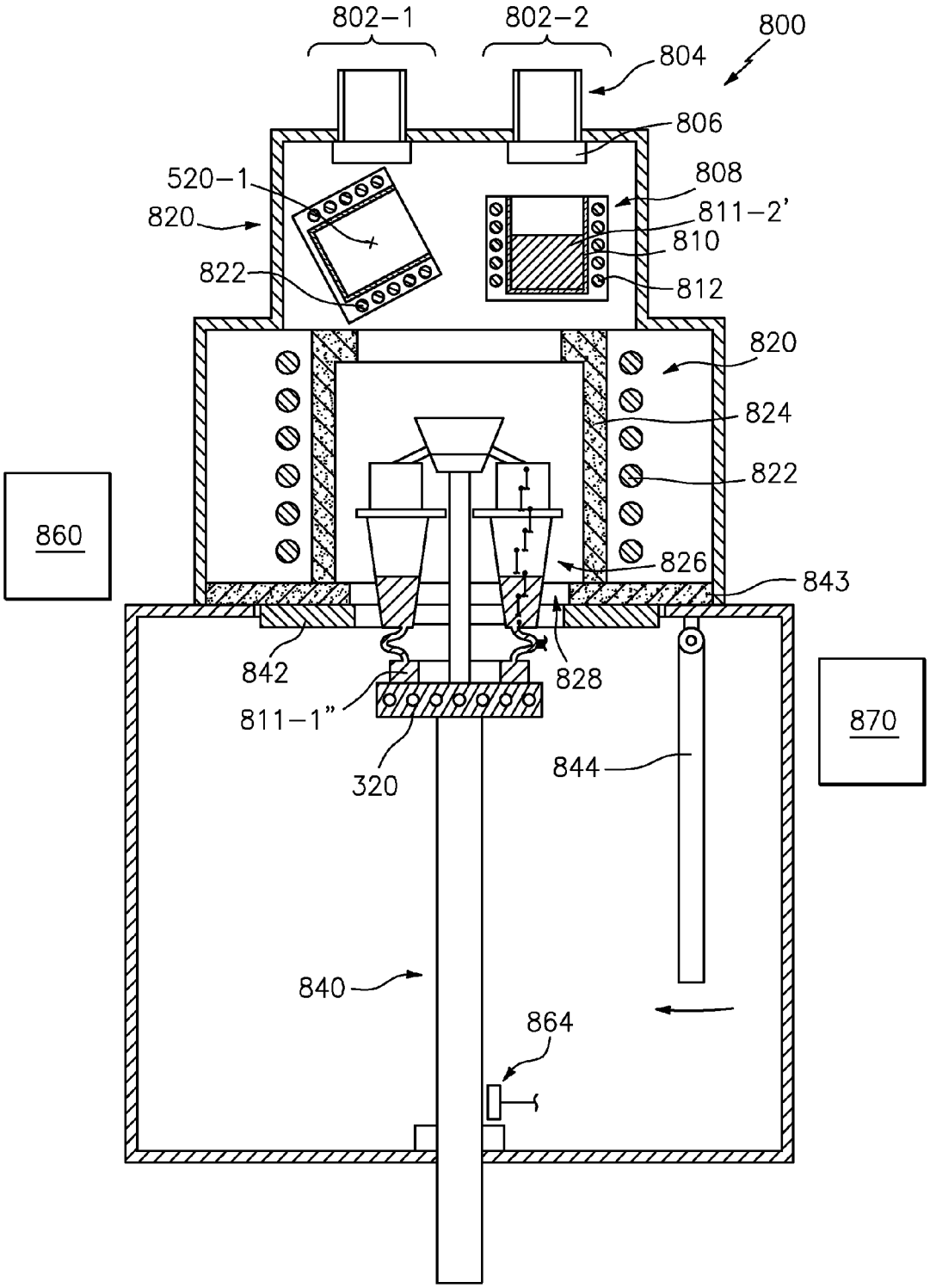
FIG. 8 is a fifth partially schematic view in the sequence of partially schematic views of the furnace casting the first blade.
Figure 9:
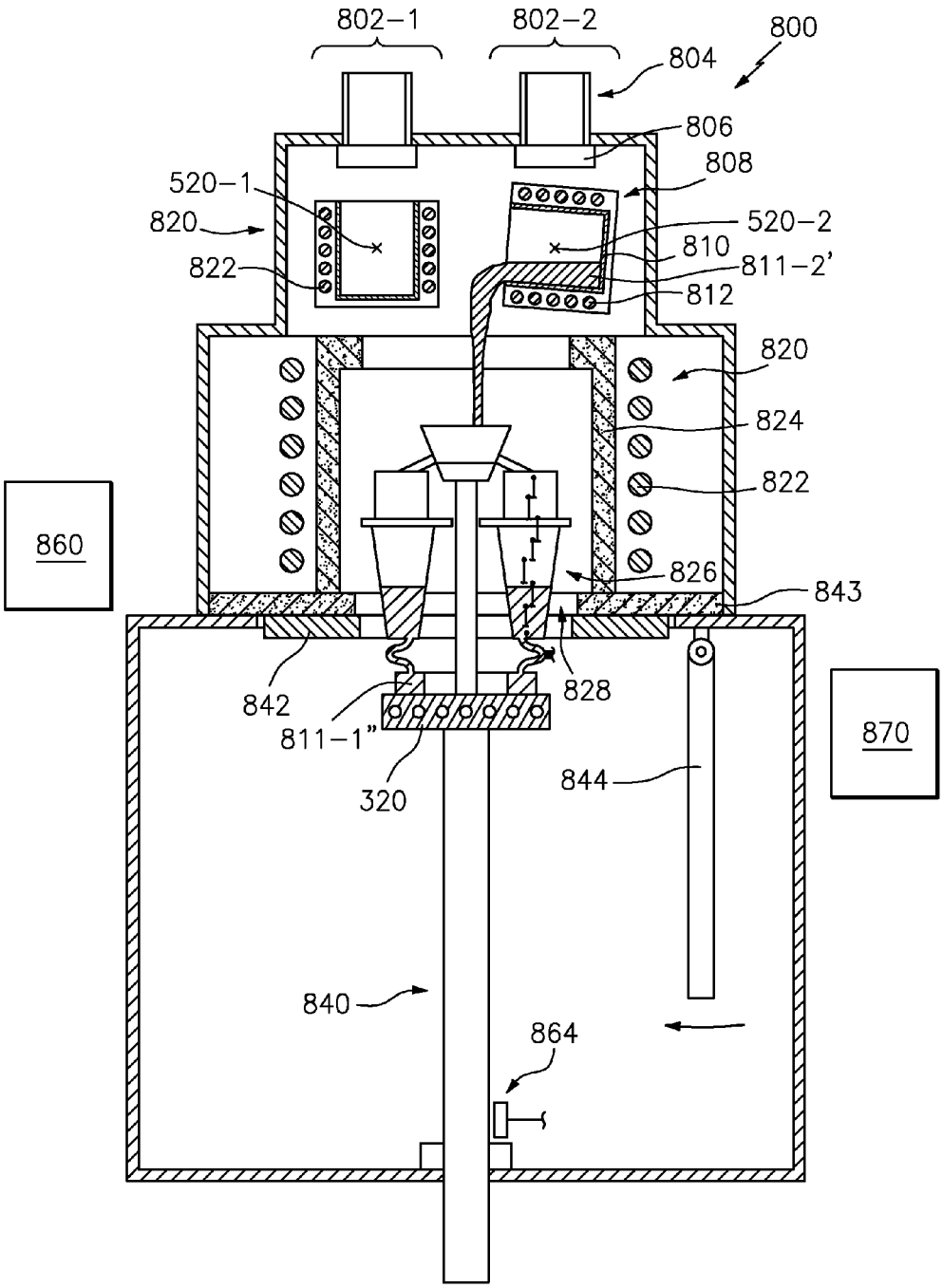
FIG. 9 is a sixth partially schematic view in the sequence of partially schematic views of the furnace casting the first blade.

FIGS. 7, 8 and 9 show the first melter being returned to the upright condition while the mold is retracted with first pour 811-1".

FIG. 9 shows the second melter pouring the second metal.

Figure 10:
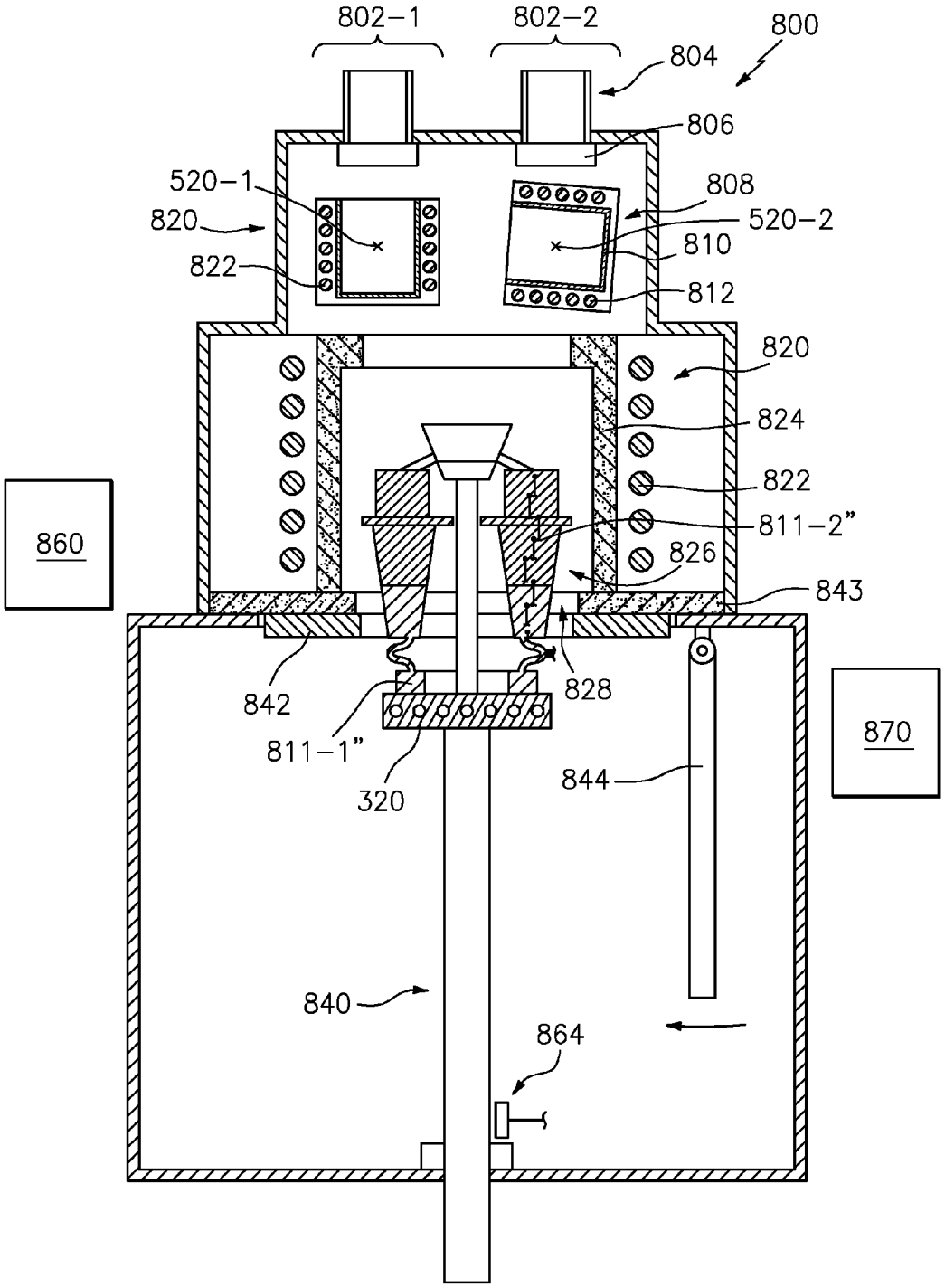
FIG. 10 is a seventh partially schematic view in the sequence of partially schematic views of the furnace casting the first blade.
Figure 11:
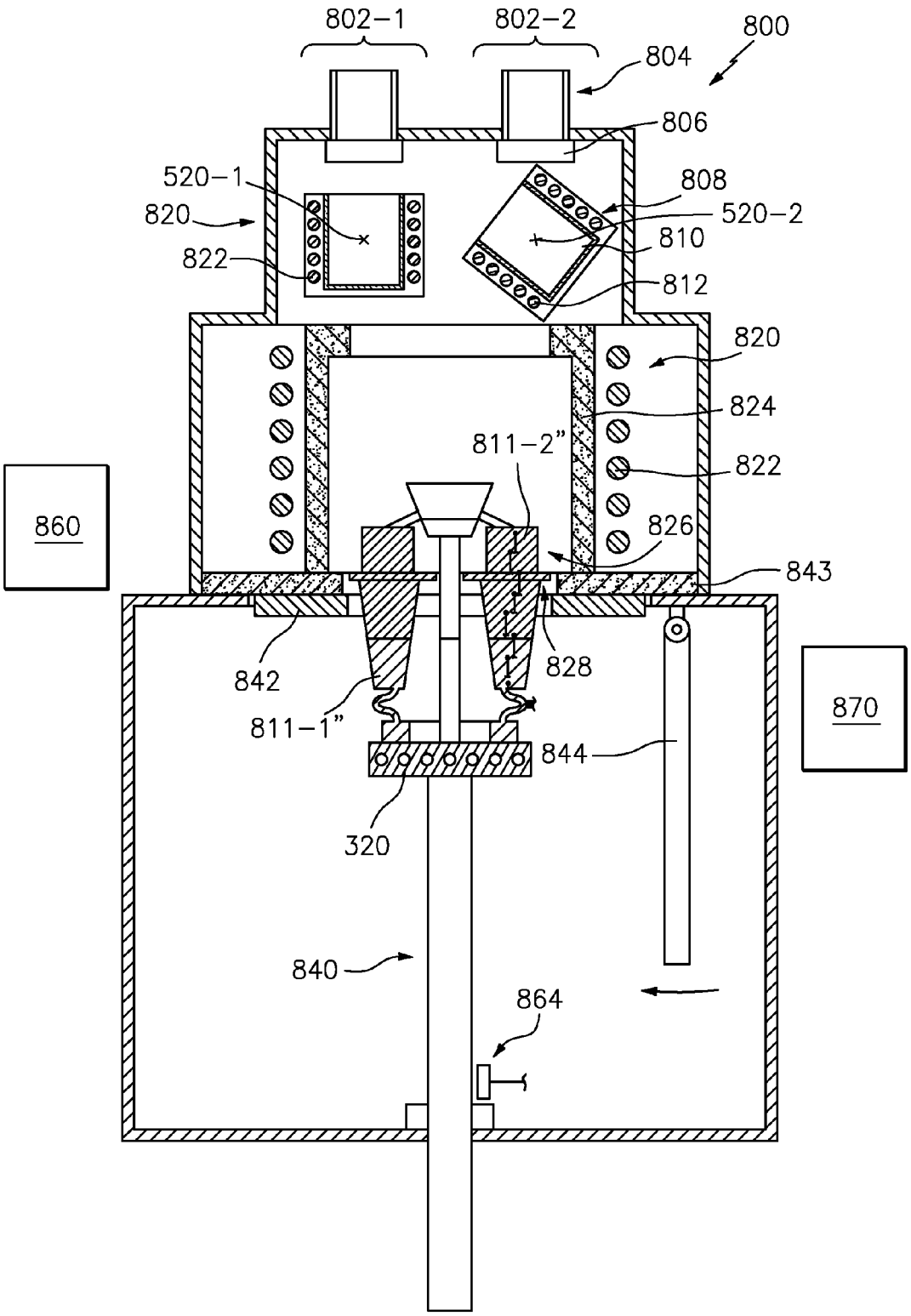
FIG. 11 is an eighth partially schematic view in the sequence of partially schematic views of the furnace casting the first blade.
Figure 12:
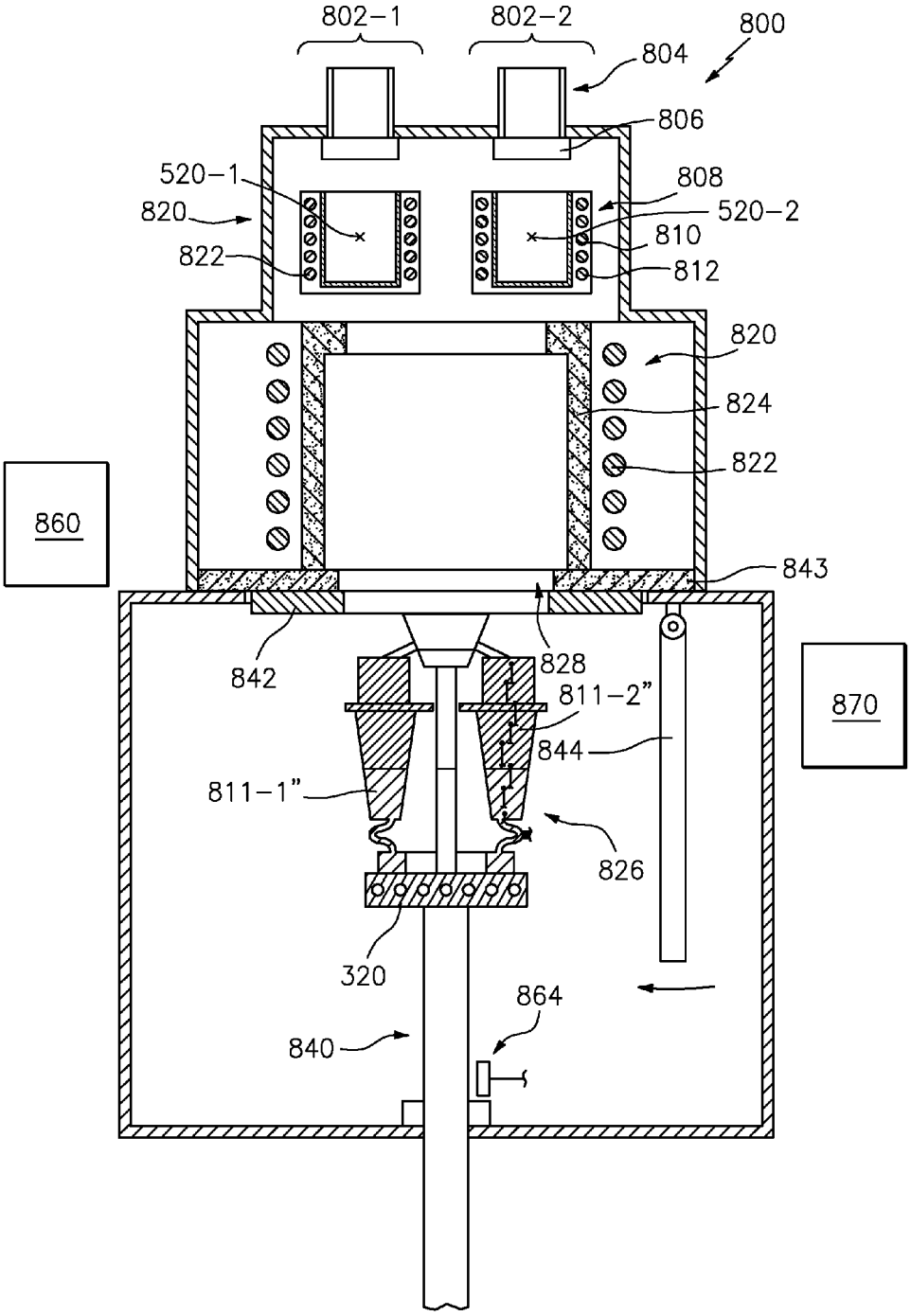
FIG. 12 is a ninth partially schematic view in the sequence of partially schematic views of the furnace casting the first blade.

FIGS. 10, 11, and 12 show the second melter returning upright while the mold is further retracted with second pour 811-2".

It is desirable to commence the second pour when the solidification front has nearly reached the surface of the first pour and only a desired height of unsolidified material remains.

Figure 4A:
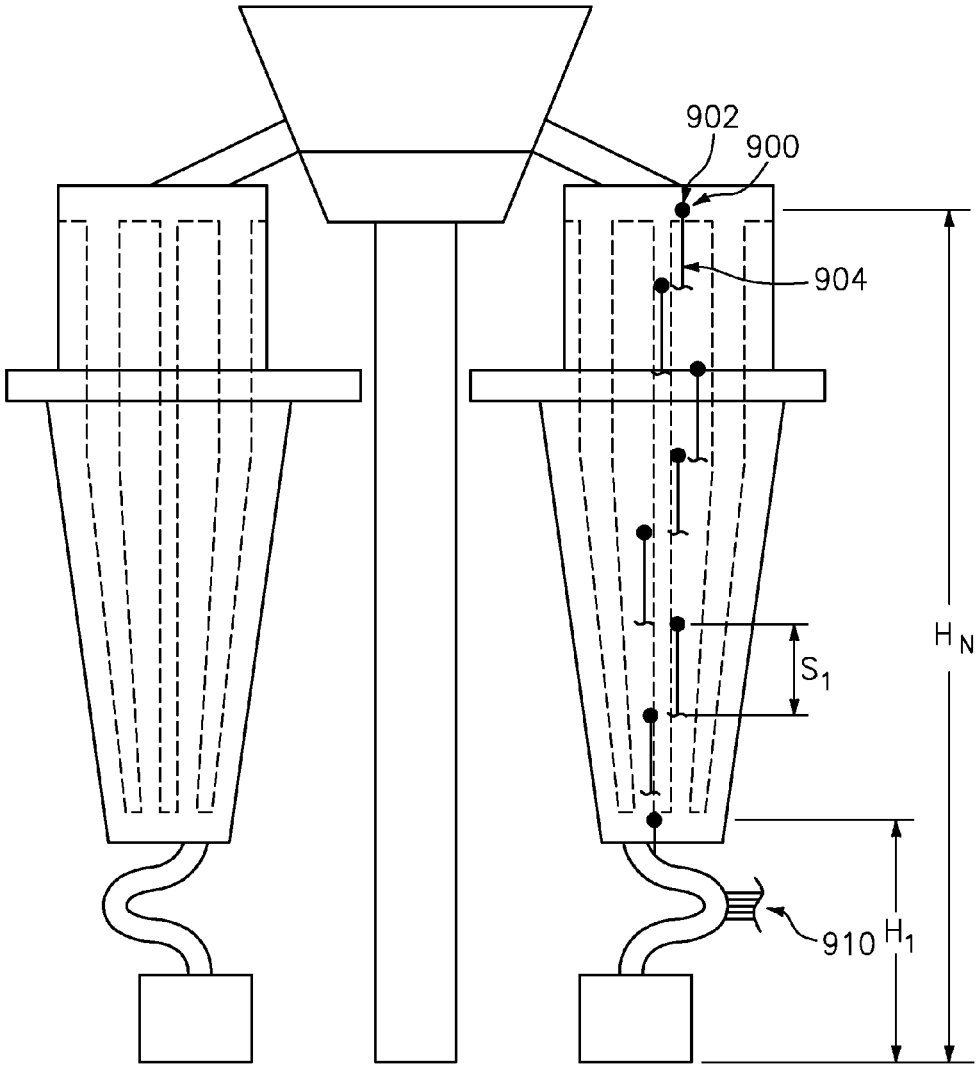
FIG. 4A is an enlarged view of a mold in the furnace of FIG. 4.

Accordingly, FIG. 4A shows a mold having an array of thermocouples 900 vertically spaced along one or more of the pattern-forming cavities and used to measure mold temperature during the casting process. Each exemplary thermocouple 900 has a junction 902 (discussed further below) and leads 904. The leads of the multiple thermocouples may be assembled into a bundle 910.

The leads may connect to a system controller 860 (FIG. 4) which controls operation of the furnace and receives input from various sensors. Alternatively or additionally, the thermocouples may be connected to an external measurement device (e.g., computer) 870. FIG. 4 further shows a position sensor 864 of the furnace which may be used to measure the vertical position of the chill plate and (thereby, the mold). The sensor 864 may be connected to the system controller 860 and/or the device 870. Subsequent position determinations may be by such direct measurement or may be made via integrating a withdrawal speed of the elevator supporting the mold.

In the exemplary embodiment, a thermocouple-to-thermocouple vertical spacing is shown as $S_1$. This may be essentially a fixed spacing (e.g., with less than 5% variance, more narrowly, less than 1%). An exemplary number of thermocouples is 5-20 in any given grouping. FIG. 4A shows the lowermost thermocouple at a height $H_1$ above the upper surface of the chill plate and an uppermost thermocouple at a height $H_N$.

The thermocouple array may be utilized in several ways during both a setup procedure and in later validation or monitoring of a production run. An exemplary setup procedure involves modeling the solidification of the first pour and only the first pour need be introduced. For such purposes, it may be possible that the array is concentrated only in the area to be filled by the first pour. At an exemplary setup situation, the furnace heats the mold to a temperature higher than the melting point of the first alloy (e.g., by approximately 200° F.-300° F. (111° C.-167° C.)). The first shot is poured. The mold is then downwardly withdrawn (e.g., at a selected target speed (e.g., typically between 2.5 and 50 centimeters per hour)). During withdrawal, both the position (via sensor 864) and temperature (via the thermocouples 900) are monitored and recorded.

The liquidus $T_L$ and solidus $T_S$ temperatures of the alloy are known. With withdrawal, the temperature at a given thermocouple will eventually decay first to the liquidus temperature and then to the solidus temperature. This data can be used to model the progression of the liquidus and solidus fronts. From this, it can be predicted at what point in the travel of the mold at a given rate of withdrawal) the liquidus front and/or solidus front will reach a desired target level. For example, a desired target level for introducing the second pour would be when the solidus front has not quite reached the top of the body of the first pour in the cavity. Optionally, the liquidus front may have reached the top or may be slightly therebelow.

Figure 16:
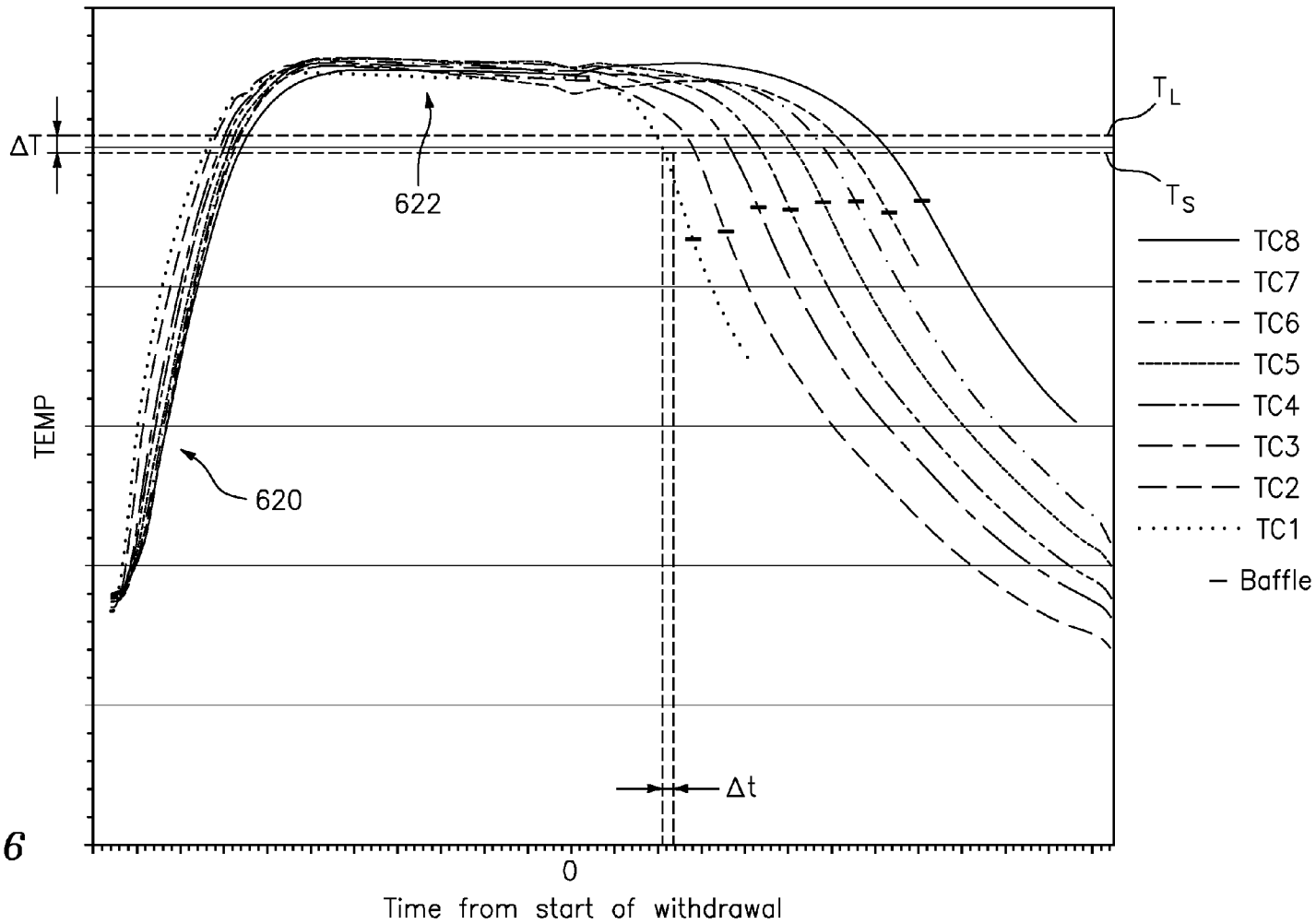
FIG. 16 is temperature-time plots for an exemplary eight thermocouples.

FIG. 16 shows temperature-time plots for an exemplary eight thermocouples numbered TC1-TC8 evenly-spaced from bottom to top along the mold. Withdrawal of the mold occurs at a fixed speed v starting at time zero. Before that the figure shows a mold heating interval 620 and a mold hold interval 622.

Figure 17:
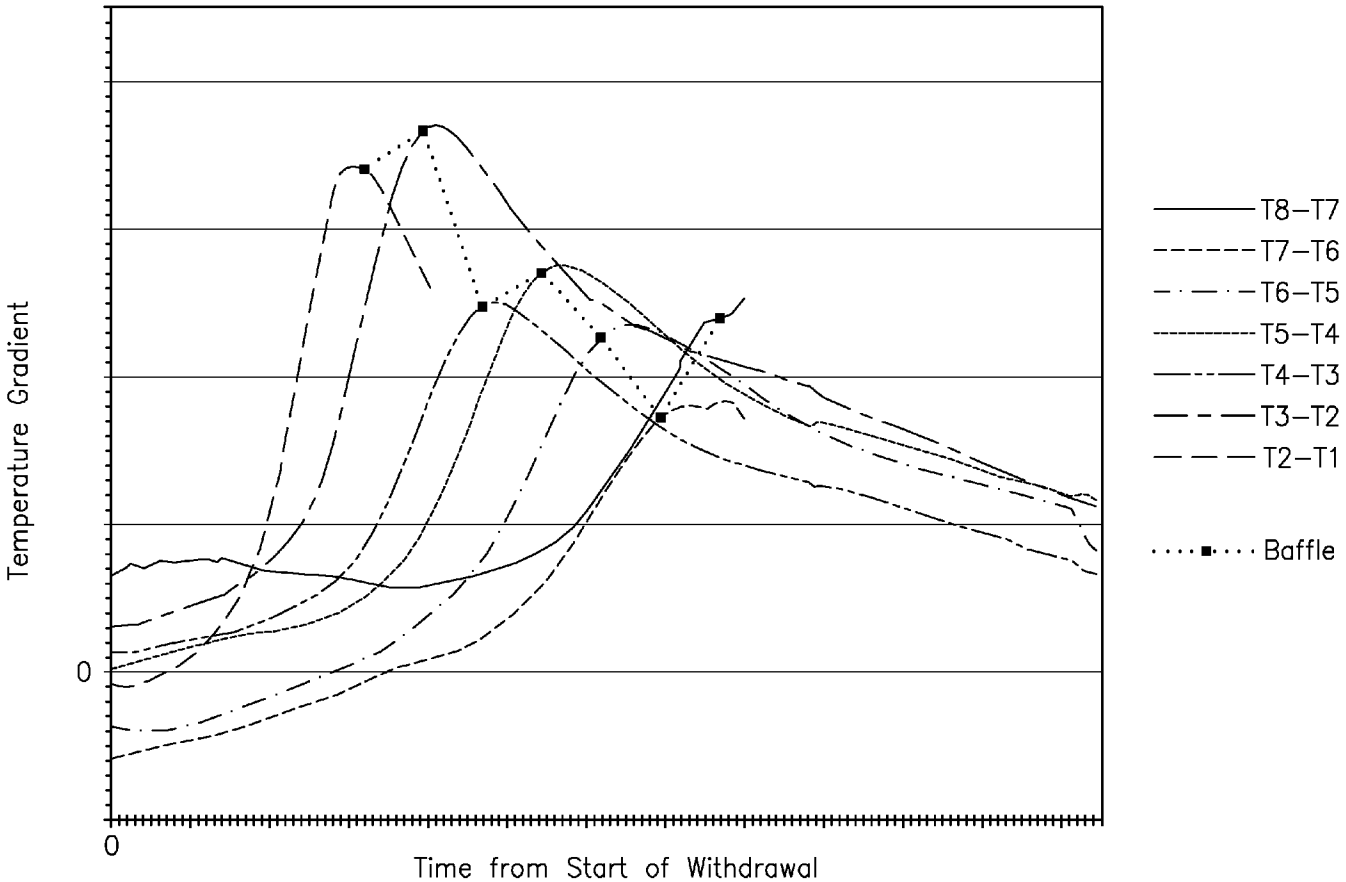
FIG. 17 is plots of the thermocouple-to-thermocouple temperature gradient.

FIG. 17 shows the thermocouple-to-thermocouple temperature gradient (temperature difference divided by vertical separation distance $S_1$). It also shows for each pair the time when a midpoint between the pair passes the top of the furnace baffle.

Figure 18:
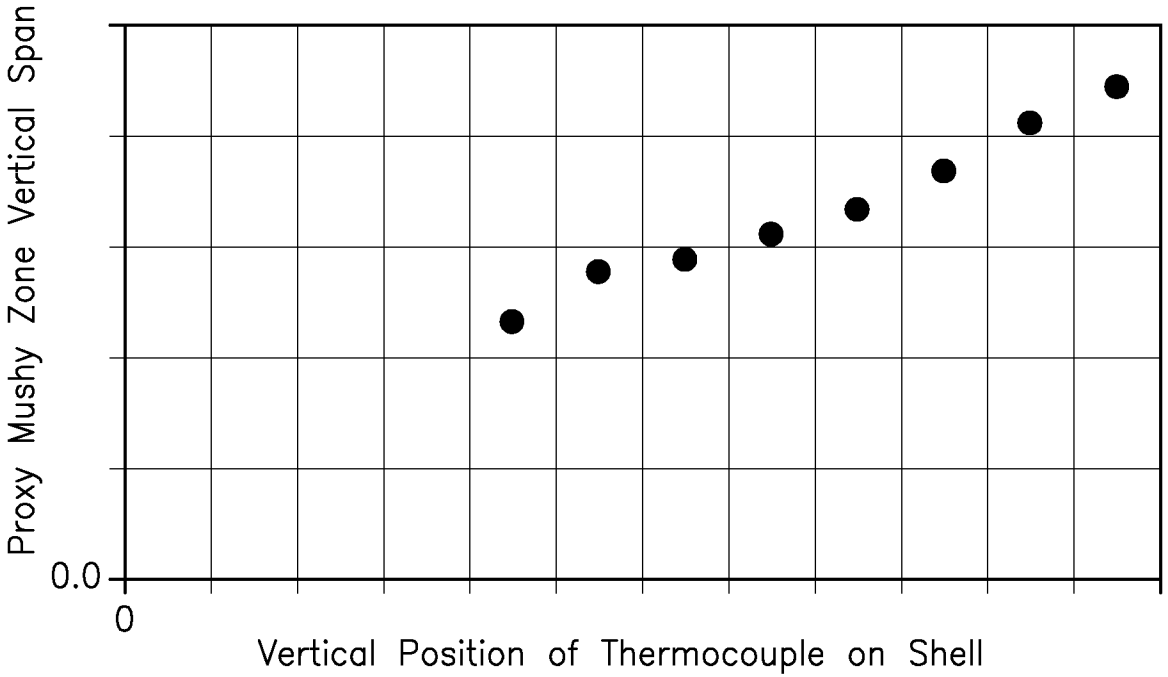
FIG. 18 is a plot of a proxy mushy zone vertical span against thermocouple position for an array of eight thermocouples.

FIG. 18 shows a plot of a proxy mushy zone vertical span against thermocouple vertical position. Use of such parameters is discussed in detail in an embodiment below.

For example, assume that it is desired to commence the second pour exactly when the liquidus front reaches the surface of the first pour. Based upon the thermocouple input for the given initial conditions (furnace temperature) and rate of withdrawal it may be calculated at what time interval after beginning of withdrawal or what associated position of the chill plate and mold along their withdrawal route this will occur. The controller 860 may then be programmed to commence the second pour after such time has transpired (e.g., recorded by internal clock in the controller) or when the chill plate and mold have reached the target position (determined by input from the sensor 864).

Once a target set of withdrawal and pour parameters has been established, the process may be repeated with measurements being taken through the second pour. This may allow monitoring of the effect of the second pour in causing any further meltback of material that had already solidified.

One may use this data to achieve desired parameters of the second pour or further revise the withdrawal parameters and parameters of the first pour.

Figure 13:
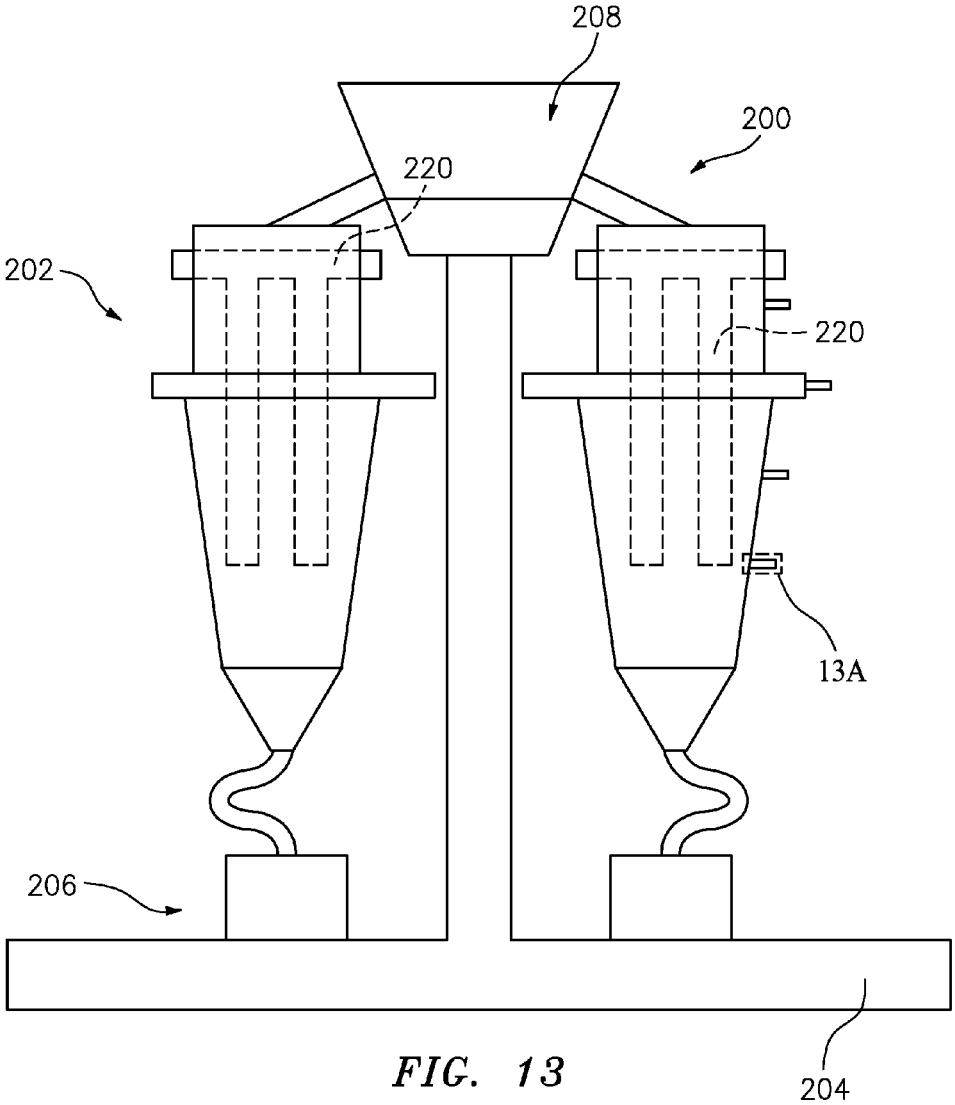
FIG. 13 is a simplified view of a pattern assembly.
Figure 13A:
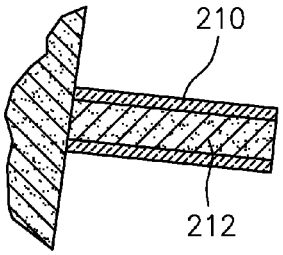
FIG. 13A is an enlarged view of a thermocouple well area of the pattern assembly of FIG. 13.

In an exemplary sequence of shell manufacture, a conventional wax pattern assembly 200 (FIG. 13) may be made (e.g., of blade patterns 202 assembled to a base plate 204 (via grain starters 206) and to a pour cone 208). Thereafter, thermocouple wells (e.g., molded ceramic) 210 (FIG. 13A) filled with wax 212 are attached to the pattern at locations corresponding to the thermocouple locations. Exemplary blade patterns 202 have airfoil, platform and root sections with a casting core 220 (e.g., ceramic and/or refractory metal core or core assembly) embedded in the sacrificial material (e.g., wax).

Figure 14:
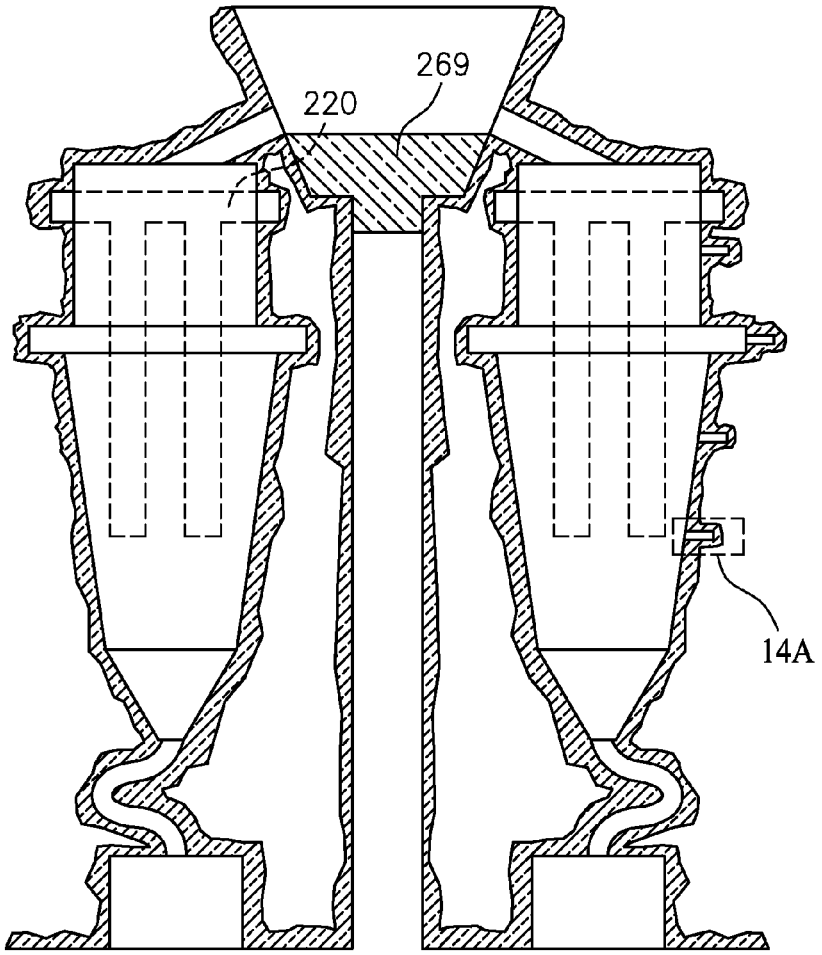
FIG. 14 is a simplified cutaway view of the pattern assembly after shelling.
Figure 14A:
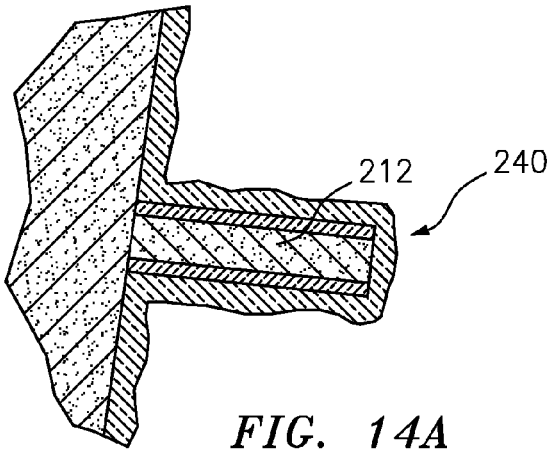
FIG. 14A is an enlarged view of a thermocouple well area of the shelled pattern of FIG. 14.

The pattern assembly is then shelled (FIG. 14) with ceramic slurry. The ends 240 (FIG. 14A) of the thermocouple wells are cut off exposing the wax 212. These ends may be part of the pre-formed well ceramic 210 at the end of a tubular sidewall and/or may be shell material formed over an open end of the well ceramic 210.

Figure 15:
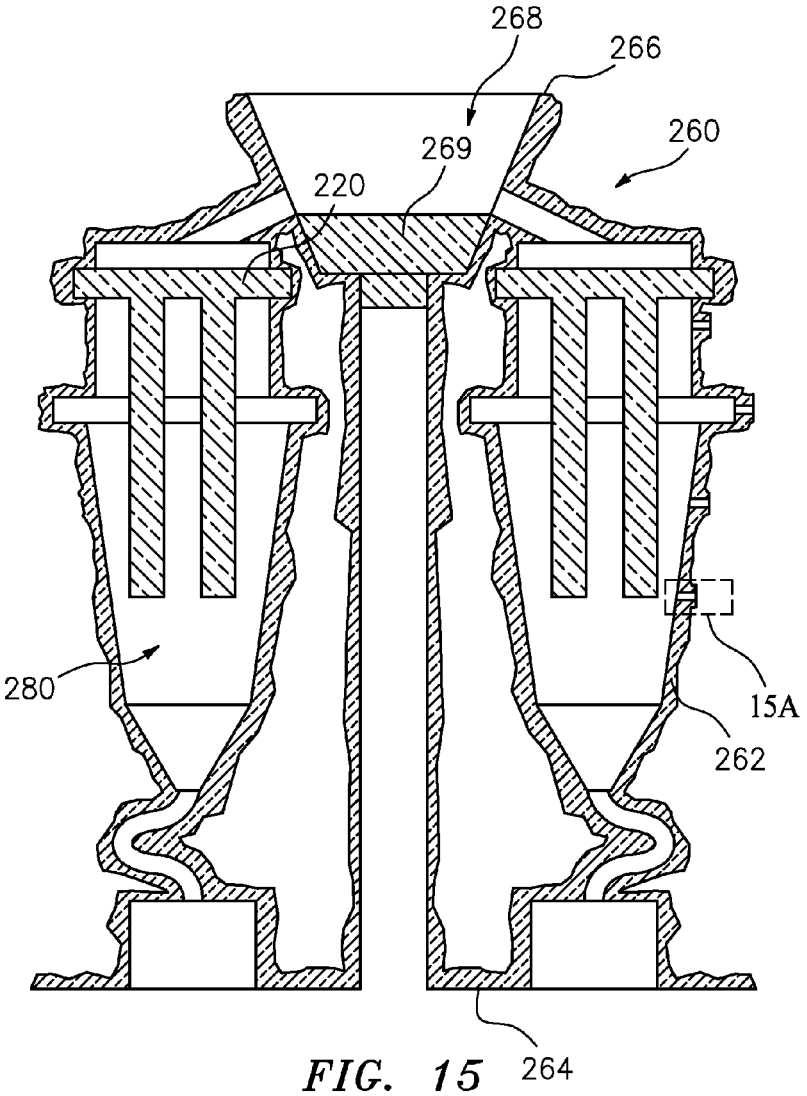
FIG. 15 is a simplified sectional view of a shell formed from the pattern assembly after thermocouple attachment.
Figure 15A:
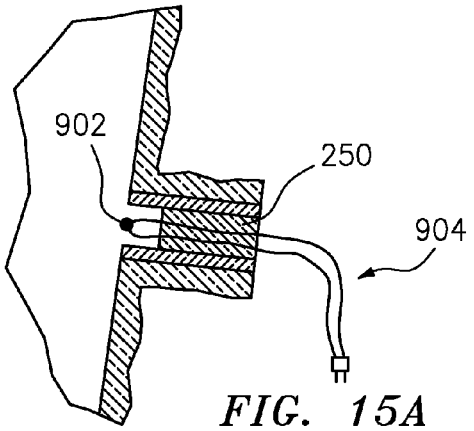
FIG. 15A is an enlarged view of a thermocouple well area of the shell of FIG. 15.

The shell is dewaxed (e.g., via steam autoclave) and then fired to harden. A thermocouple wire is embedded into each well (FIG. 15A). Each well is then sealed (e.g., with a ceramic slurry 250 such as aluminosilicate, silica, or zircon mixed with a colloidal agent such as silica). The slurry 250 is allowed to dry and then hardens when the mold is subsequently heated in preparation for receiving the pour. The resulting mold 260 formed by the shell 262 extends between a lower end 264 shaped by the pattern base plate 204 to an upper end 266 formed by a pour cone shaped by the pour cone 208. The mold/shell has an opening 268 (e.g., at a pour cone upper rim) for receiving metal 269 to be cast. An interior space includes individual portions or compartments 280 for casting each blade. Each compartment 280 contains an associated core or core assembly 220.

An alternative implementation involves use of fewer thermocouples to configure and verify a process for locating a transition of a desired character.

This example assumes a transition zone of non-negligible span between an inboard boundary 540B and an outboard boundary 540A.

In the tip-downward casting example, at boundary 540A, the composition will be essentially 100% the second pour composition. It is expected to be the solidus location of the first pour upon pouring of the second pour in the tip-downward casting example. There may be slight interdiffusion, however.

In the tip-downward casting example, at boundary 540B, the composition is considered essentially the second pour composition. This is arbitrarily defined as the location at which the composition is 95% the composition of the second pour. A small amount of the first alloy will tend to remain mixed into the melt as it solidifies upwards past boundary 540B.

Boundary 540 will have composition being the average of the two alloys and is expected to be about half way between 540A and 540B.

The engineer initially sets target locations for 540, 540A, and 540B. Thermocouples may be placed with their respective junctions 902 at these three heights. In one example, two sets (vertical arrays) of three thermocouples are placed at different locations on a given cavity or on separate cavities (e.g., at similar locations on two different mold cavities opposite each other on the mold part circle or cluster).

A test pour of the first alloy is to a height greater than the expected production pour (e.g., to fill the entire mold). Withdrawal is at a known speed (e.g., at a known speed associated with defect-free performance in similar single-pour castings). Temperature is recorded against time for each thermocouple.

As the alloy cools, a "mushy zone" is defined between respective locations at the solidus temperature and liquidus temperature. Uneven cooling means these locations can depart from being planar. An instantaneous vertical span between these two locations may be near constant along the cross-sectional area of the body of metal. Vertical span at a given location in the horizontal cross-section may vary with time as the mushy zone progresses upward relative to the mold (because the mold is being withdrawn, the mushy zone may be essentially vertically stationary relative to the furnace/factory).

A proxy used as a characteristic mushy zone vertical span is approximated as the vertical distance ("s") a particular location in the body travels from when the alloy is at the liquidus temperature until the alloy at that location on the mold is at the solidus temperature. For simplicity, the solidus and liquidus temperatures of the first-poured alloy are at least initially used. The solidus and liquidus temperatures are known in advance (determined separately using differential thermal analysis (DTA) or other method). The proxy may be calculated by the following equation:

$$s=(t_{sol}-t_{liq})*W$$

| Variable | Units | Description |
|---|---|---|
| $t_{sol}$ | min | time when the thermocouple is at solidus temp |
| $t_{liq}$ | min | time when the thermocouple is at liquidus temp |
| W | mm/min | withdrawal speed |
| s | mm | proxy mushy zone vertical span |

Figure 19:
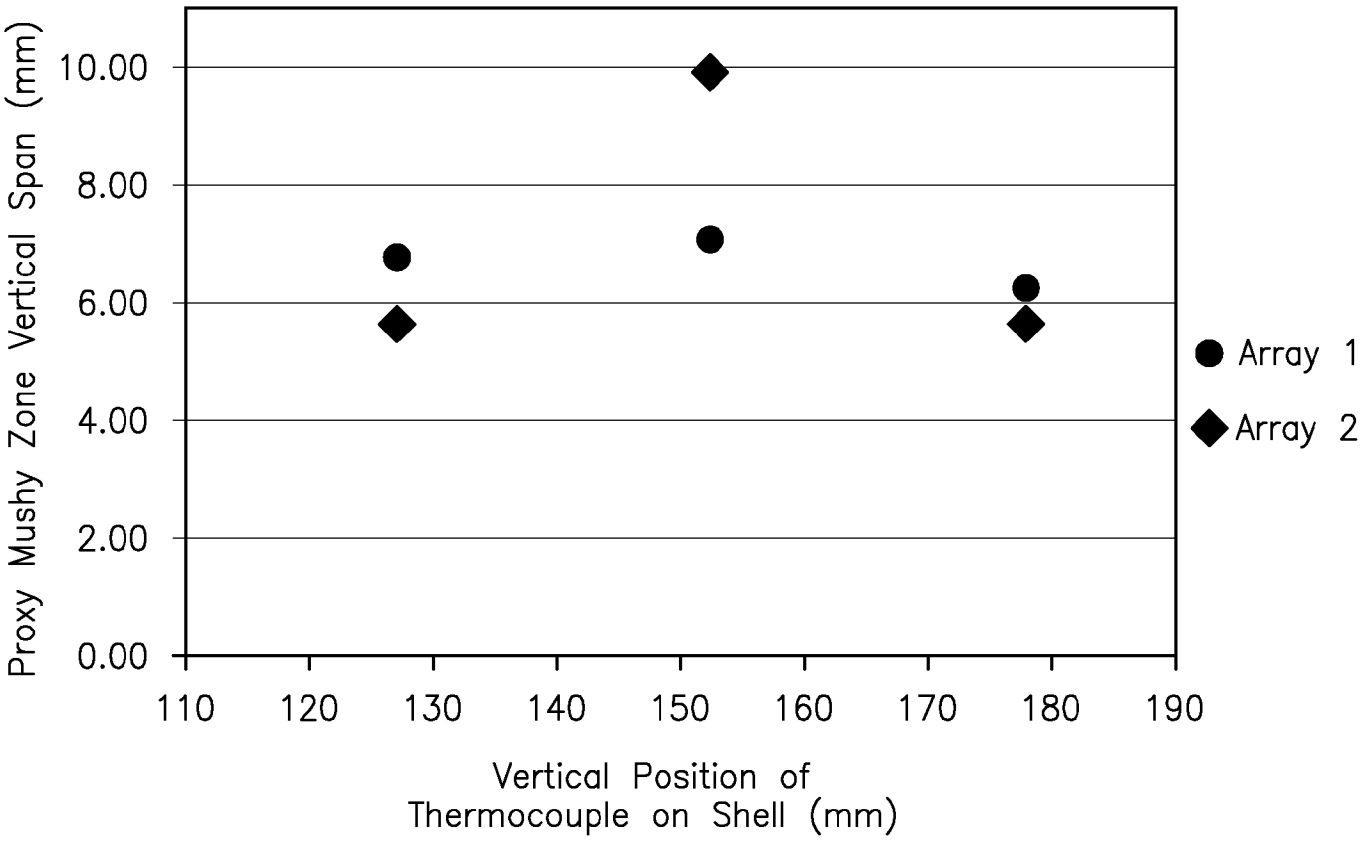
FIG. 19 is a plot of the proxy mushy zone vertical span against thermocouple positioning for two vertical arrays or sets of three thermocouples.

The results for two sets of thermocouples at respective heights of the lines are plotted in FIG. 19.

The proxy mushy zone vertical span (s) should be approximately half of the target height difference (delta h) between locations 540A and 540B (to reflect about 50% dilution by the second pour). This proxy span should stay constant at locations 540, 540A, and 540B. Parameters may be subsequently adjusted to more closely achieve a desired result.

One parameter is withdrawal speed. In the FIG. 19 example, the desired/target boundaries 540A and 540B are separated by a delta h of about 50 mm. However, the average (across the two thermocouple sets) proxy vertical span (s) at each of the three heights is substantially smaller (e.g., about 6 mm at the boundaries 540A and 540B and about 8 mm at 540). The amount to change the withdrawal rate can be determined using a design of experiment (DOE) with prior single-pour single crystal casting experience and/or prior dual-pour experience. Withdrawal rate is not required to be constant throughout the mold withdrawal cycle. For example, a database may be obtained for prior similar part geometries relating withdrawal speed to the proxy mushy zone vertical span at given locations along the part cavity. This database may be used to determine the direction and amount of any variation in speed to achieve a desired change in the proxy mushy zone vertical span.

Another parameter that can similarly be modified based upon a database of prior single-pour experience is mold temperature which may be controlled by adjusting the furnace temperature or by reconfiguration of furnace or mold geometry at a given temperature.

Another parameter is mold location within the furnace. For example, there may be uneven heating in the furnace due to a number of factors including susceptor wear. Substantial differences in the mushy zone vertical span at different lateral (X-Y, with the Z-axis being vertical) locations on the mold can lead to inconsistent transition zone height. For example, the uneven heating of the furnace may create a hot side and a cooler side. The effect of this may be rectified by centering parts differently within the furnace (e.g. moving the mold off-center toward the side that is cooler), modifying part position on the part circle during wax assembly (e.g., adopting an asymmetric part circle to compensate), or recalibrating/rebuilding (replacing a susceptor) the furnace hot zone to obtain more uniform heating.

One may modify the above parameters until the proxy mushy zone vertical span (s) at 540, 540A, and 540B for at least two thermocouple arrays at different locations about the mold is constantly within a desired amount of the target of half delta h.

In the exemplary implementation, verification/refinements may be then performed with two pours.

For initial dual alloy pours, the same thermocouple array (s) may be used. In one example, one or more thermocouples are located about the shell at the target height/level/boundary 540A (the lower of two levels 540A and 540B on the mold). Multiple thermocouples at that height serve to provide redundancy in case a thermocouple fails and to identify whether furnace gradient is inconsistent (e.g., asymmetry in furnace heating or asymmetric gradients that cause non-uniformity in cooling of a given part).

The first alloy is poured to fill to target line 540. The shell is withdrawn using the iterated withdrawal speed and any other parameters determined previously. These other parameters may include: off-center mold position and asymmetric configuration discussed above; other mold configuration for uniform mushy zone across a given part cavity; furnace temperature; and the like. The second alloy is poured when the thermocouple(s) at level 540A measures the solidus temperature of the first alloy (determined separately as above). The distance the mold has been withdrawn from the furnace hot zone at the time of pouring the second alloy relative to the time of pouring the first alloy is defined as withdrawal distance.

The actual locations of 540, 540A, and 540B (using the definition of 540A provided previously) may be determined after the casting is deshelled. This may be done by measuring the variation of a single element that is present in significantly different concentrations in the two alloys. This can be done using x-ray florescence or other methods.

If the measured/observed transition span (between the actual/measured levels 540B and 540A) is too large or small, it will be necessary to determine a different withdrawal rate. This effect may be more pronounced when the two alloys have significantly different solidus and/or liquidus temperatures, because the casting parameters determined with the first alloy will have different results in the section of the part containing a mixture with the second alloy. If the measured/observed transition span is larger than expected, the target mushy zone vertical span may be reduced (and vice versa). An initial variation may be proportional to the percent variation of the actual transition span from expected. The casting parameters may be reoptimized as above with the first alloy until this new mushy zone vertical height is achieved. Thereafter, the two alloy pours may be repeated and the actual levels 540A and 540B observed and the process repeated until actual transition zone location/size within a desired range.

Once the desired alloy transition zone span is achieved, these parameters shall be held constant for all future molds. The molds will no longer require thermocouples to be applied each time. The withdrawal distance may be the only indicator of when to pour the second alloy when all parameters are held constant.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A method for using a casting mold, the casting mold comprising:

a shell extending from a lower end to an upper end and having:

an interior space for casting metal; and an opening for receiving metal to be cast; and a plurality of thermocouples having respective junctions embedded in the shell and vertically-spaced from each other, the method comprising:

placing the mold in a furnace;

withdrawing the mold from the furnace;

during the withdrawing, determining a position of the mold and receiving data from the thermocouples; and determining when a solidus front and a liquidus front pass each thermocouple in a vertical direction.

2. The method of claim 1 further comprising:

calculating a cooling rate at each thermocouple.

3. The method of claim 1 further comprising:

determining a proxy vertical span of a mushy zone as a distance the mold has traveled between when said solidus front and said liquidus front pass an associated said thermocouple.

4. The method of claim 1 further comprising:

determining a vertical position of a mushy zone.

5. The method of claim 4 wherein:

the pouring comprises:

a first pouring of a first alloy; and a second pouring of a second alloy; and the second pouring commences when the mushy zone has reached a target level.

6. The method of claim 5 performed repeatedly wherein:

parameters are iterated to achieve a desired value of a proxy for a vertical span of the mushy zone.

7. The method of claim 6 wherein:

the proxy is the vertical distance the mold passes from when the solidus front passes a thermocouple of the plurality of thermocouples to when the liquidus front passes the thermocouple.

* * * * *